US006817831B2

(12) United States Patent
Stevens et al.

(10) Patent No.: US 6,817,831 B2
(45) Date of Patent: Nov. 16, 2004

(54) ENGINE-COOLING FAN ASSEMBLY WITH OVERLAPPING FANS

(75) Inventors: William M. Stevens, Maynard, MA (US); F. Raymond Coté, Dover, MA (US)

(73) Assignee: Robert Bosch Corporation, Waltham, MA (US)

( * ) Notice: Subject to any disclaimer, the term of this patent is extended or adjusted under 35 U.S.C. 154(b) by 0 days.

(21) Appl. No.: 10/390,218

(22) Filed: Mar. 17, 2003

(65) Prior Publication Data

US 2004/0020449 A1 Feb. 5, 2004

Related U.S. Application Data

(60) Provisional application No. 60/364,746, filed on Mar. 15, 2002.

(51) Int. Cl.[7] ..... F01D 1/24

(52) U.S. Cl. ..... 415/61; 416/120; 416/198 R

(58) Field of Search ..... 415/61, 65, 228; 416/120, 198 R, 189

(56) References Cited

U.S. PATENT DOCUMENTS

| | | | |
|---|---|---|---|
| 1,550,177 | A | 8/1925 | Lungstrom et al. |
| 2,729,389 | A | 1/1956 | Koch |
| 4,684,324 | A | 8/1987 | Perosino |
| 4,863,351 | A | 9/1989 | Fischer et al. |
| 5,000,660 | A | 3/1991 | Van Houten et al. |
| 5,066,196 | A | 11/1991 | Morofushi |
| 5,649,587 | A | 7/1997 | Plant |
| 5,931,640 | A | 8/1999 | Van Houten et al. |
| 6,491,502 | B2 | 12/2002 | Hunt |

FOREIGN PATENT DOCUMENTS

| | | |
|---|---|---|
| DK | 3831081 | 4/1989 |
| GB | 2179706 | 3/1987 |

*Primary Examiner*—Edward K. Look
*Assistant Examiner*—James M. McAleenan
(74) *Attorney, Agent, or Firm*—Fish & Richardson, P.C.

(57) ABSTRACT

An automotive engine-cooling fan assembly uses pairs of overlapping fans to improve flow uniformity through the heat exchanger cores and to maximize the amount of fan power that can be achieved with limited motor sizes. One fan of each pair has upstream supports and the other has downstream supports, and these supports are so configured to minimize the axial dimension of the assembly. The use of banded fans maximizes fan performance, and blade skew minimizes fan noise.

30 Claims, 7 Drawing Sheets

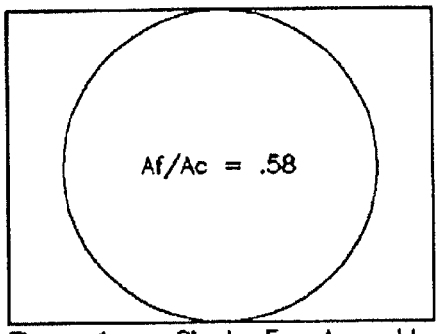
Figure 1a – Single–Fan Assembly
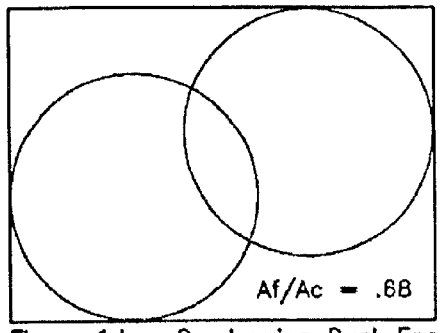
Figure 1d – Overlapping Dual–Fan Assembly
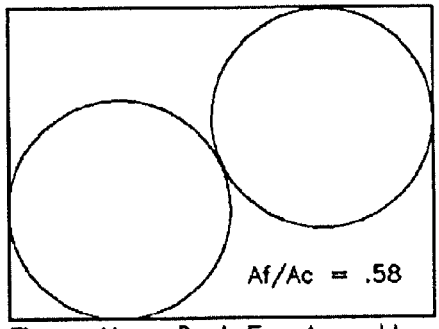
Figure 1b – Dual–Fan Assembly
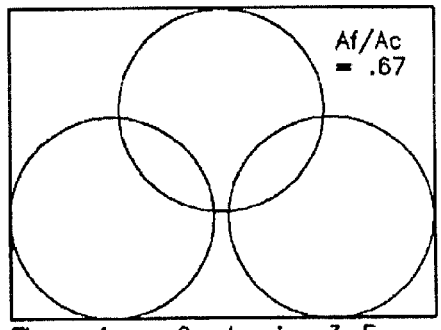
Figure 1e – Overlapping 3–Fan Assembly
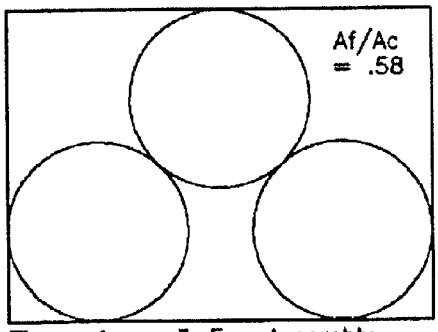
Figure 1c – 3–Fan Assembly
Figure 1 – Schematics Showing Various Fan Configurations on 1.35 Aspect Ratio Core

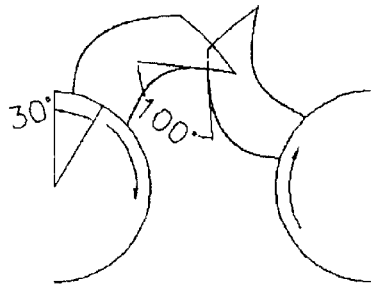
30° rotation angle
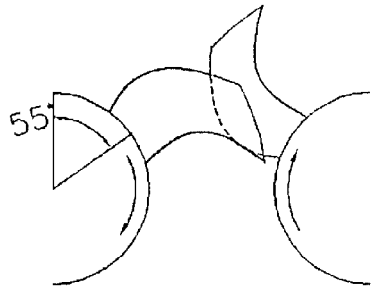
55° rotation angle
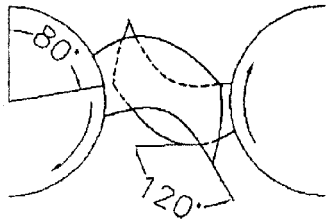
80° rotation angle
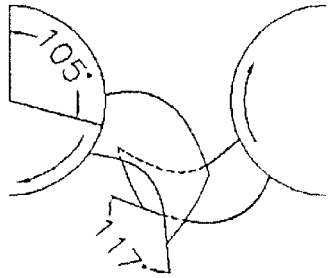
105° rotation angle
Figure 7

ENGINE-COOLING FAN ASSEMBLY WITH OVERLAPPING FANS

Under 35 USC §119(e)(1), this application claims the benefit of prior U.S. provisional application 60/364,746, filed Mar. 15, 2002.

BACKGROUND

A typical automotive engine-cooling fan assembly consists of one or more fans, each powered by an electric motor, and housed in a shroud which guides air through one or more heat exchangers. Each motor is typically supported by arms, or stators, which are supported by the shroud. Such a fan assembly can be placed upstream or downstream of the heat exchangers, which typically include both a radiator which cools the engine and an air conditioning condenser.

A fan assembly is required to efficiently provide the required amount of engine cooling while satisfying various noise criteria. These noise criteria usually concern both broadband noise and tones. At a given fan power, broadband noise is often found to be minimized by maximizing fan diameter, although fan noise, and particularly the tonal content of fan noise, increases if the fan overlaps an edge of the heat exchanger.

Fan efficiency is also often improved by maximizing fan diameter. One reason for this is that power expended in accelerating air through the fan is generally not recovered. This power is minimized by maximizing the fan area. Another reason is that a larger fan area provides better coverage of the heat exchangers. Due to the typically shallow depth of the fan assembly, the velocity of air through the heat exchanger cores outside the fan projected area is generally less than that inside the fan projected area. This flow non-uniformity increases the mean pressure drop, and decreases the effectiveness of the heat exchangers.

When the heat exchanger core area is approximately square, flow non-uniformity can be made reasonably small by using a single fan, the diameter of which is approximately equal to the length of a side of the square. When one dimension (typically the width) of the core is larger than the other dimension (typically the height), noise considerations generally limit the fan diameter to the smaller dimension. As a result, flow non-uniformity for a non-square core is generally larger than in the case of a square core, unless the aspect ratio of the core (the ratio of the longest side to the shortest side) is large enough to make practical the fitting of two fans side by side. Although the ideal core aspect ratio for a dual-fan assembly is two, such an assembly can offer a significant advantage in flow non-uniformity at smaller aspect ratios.

A measure of the extent to which a given fan arrangement provides good coverage of a heat exchanger core is the area ratio $A_f/A_c$. This is the ratio of the total fan disk area $A_f$ to the area of the heat exchanger core $A_c$. For a single fan on a square core, the largest area ratio achievable without overlapping the edge of the core is □/4, or 0.79. This is also the largest value achievable with a side-by-side dual-fan arrangement on a core of aspect ratio 2.

In practice, many automotive heat exchangers have an aspect ratio approximately midway between one, corresponding to a square and ideal for a single fan, and two, ideal for a dual fan. This presents a problem for the fan designer in that neither a single-fan configuration nor a conventional dual-fan arrangement has a favorable flow distribution through the cores. An aspect ratio of approximately 1.35 represents perhaps the worst case, where the ratio of fan area to core area is equally small for single-fan and dual-fan assemblies. Schematics of these two arrangements are shown in FIGS. 1*a* and 1*b*. For both single-fan and dual-fan assemblies, the area ratio is approximately 0.58. In fact, a 3-fan assembly, as shown in FIG. 1*c*, also has an area ratio of 0.58. Because the total fan area of the configurations shown in FIGS. 1*a*, 1*b*, and 1*c* are approximately equal, the efficiency and noise of these configurations will be approximately equal, as well.

In addition to the problem of maximizing fan area, another problem sometimes faced is maximizing fan power. This sometimes favors the use of multiple fans. In particular, in those cases where the largest motor available is too small to deliver the required cooling in a single-fan system, a multiple-fan assembly can be required, even at the expense of optimum system efficiency. This situation can be encountered when designing electric cooling systems to replace engine-driven fans for the cooling of light trucks. It also is likely to be encountered in the cooling of the new generation of fuel cell vehicles.

SUMMARY OF THE INVENTION

The present invention is an automotive engine-cooling fan assembly using two or more fans, where at least two fans overlap each other when viewed from the upstream or downstream direction. The set of arms which supports the motor driving one fan of an overlapping pair of fans is upstream of that fan, and the set of arms which supports the motor driving the other fan of the pair is downstream of that other fan. Overlap of a pair of fans can be demonstrated by projecting those fans onto a plane perpendicular to the axis of one or both of the fans. A first circular disk centered on the projection of the axis of one fan (the diameter of the first disk being equal to the diameter of that fan) overlaps a second circular disk centered on the projection of the axis of the other fan (the diameter of the second disk being equal to the diameter of that other fan).

In a preferred embodiment, the axial position of the set of arms which supports the motor driving each fan of an overlapping pair is substantially the same as the axial position of the other fan of that pair. The set of support arms for each fan of the pair excludes any members which would interfere with the placement of the other fan of the pair at the same axial location as that set of arms. This allows the module to be quite compact in the axial direction.

Preferably, a small clearance gap is maintained between said shroud and each of the fans along the portion of the fan's circumference outside the overlap region. Preferably, a projection of the shroud opening, in a plane perpendicular to one or both of the fan axes is two generally circular elements that overlap in the region of fan overlap.

In a preferred embodiment, the two motors are approximately the same distance from the heat exchanger core. In this embodiment the distance between the core and the farthest point on one of the motors is between 0.8 and 1.25 times the distance between the core and the farthest point on the other motor. The length of the motors is often a limiting factor in making a fan assembly which is axially compact.

When a fan assembly according to a most preferred embodiment is viewed axially from upstream or downstream, the projected area of the set of arms supporting the motor driving one fan of the overlapping pair falls outside the projected disk area of the other fan of the pair.

In one embodiment the fan assembly is a dual-fan assembly. This arrangement provides good flow uniformity through a heat exchanger core in those cases where single-fan assemblies or conventional side-by-side dual-fan assemblies cannot, namely in those cases where the shroud covers a rectangular area of the heat exchanger core, and where the aspect ratio of that rectangular area is approximately midway between 1 and 2. In a preferred embodiment the assembly is a dual-fan system and is sized to move air through a core area with an aspect ratio of approximately 1.25 to 1.8. In a most preferred embodiment the assembly is a dual-fan system and the fan diameters are equal, or, if unequal, the fan diameter of the smaller fan is greater than 85 percent of the diameter of the larger fan, and the diameter of the larger fan is greater than 75 percent of the smaller dimension of the core area.

In other embodiments the fan assembly comprises more than two fans.

In preferred embodiments the extent of overlap, when measured in a plane which contains the rotation axis of at least one fan of an overlapping pair of fans and at least one point on the axis of the other fan, is greater than 10 percent of the diameter of the smaller of the two fans, and less than the blade span of the smaller fan. The diameter of the fan is taken to be the swept diameter of the fan blade tip, and the blade span is the radial distance from the hub to the fan blade tip. Overlap, diameter, and blade span are exclusive of any rotating tip band. Any greater overlap is likely to generate acoustic tones. The benefits of the invention will be relatively small if less overlap is used.

Although in some embodiments the fans are powered by hydraulic motors, in preferred embodiments they are powered by electric motors. One advantage of the invention is that it allows the use of two or more large motors in a relatively small package, where a side-by-side arrangement would limit the fan diameter to a size unable to absorb a large amount of motor power efficiently, and where an overlapping fan arrangement using two downstream or two upstream motor supports would be too deep to fit in the vehicle.

In preferred embodiments the shroud forms a plenum between the heat-exchanger core and the fans, and that plenum is deeper in those areas adjacent to fans with upstream support arms. This maximizes plenum depth for a given axial depth of shroud, and minimizes flow non-uniformity.

In preferred embodiments, recirculation is controlled by maintaining a small gap between each fan and the shroud in the non-overlapping portion of the fan circumference—the portion which is not upstream or downstream of any other fan. This gap is preferably less than 2 percent of the fan diameter.

In preferred embodiments, banded fans are used. This type of fan, which has a rotating band attached to the blade tips, can maintain tip loading more effectively than a free-tipped fan in the overlap region.

The direction of rotation is specified relative to a viewer axially downstream of the assembly. In some embodiments one fan of an overlapping pair rotates in the clockwise direction and the other fan of the pair rotates in the counter-clockwise direction. This causes the fan blades to move in the same direction in the overlap region. This arrangement increases the total swirl velocity in the overlap region, reducing efficiency compared to the arrangement where the blades move in the opposite direction in the overlap region. However, the reduced relative velocity at the downstream fan can reduce fan noise relative to the alternative arrangement. Another advantage is that, due to the motor mounting arrangement, both fan motors have the same rotation direction relative to the motor. In some cases, identical motors can be used.

In other embodiments both fans of an overlapping pair rotate in the same direction (both clockwise or both counter-clockwise). This causes the fan blades to move in opposite directions in the overlap region. Due to swirl cancellation, this arrangement can be somewhat more efficient than the arrangement where the blades move in the same direction in this region. However, the increased relative velocity at the downstream fan can increase fan noise relative to the alternative arrangement.

In preferred embodiments the two fans of an overlapping pair have unequal numbers of blades. Also in preferred embodiments, the blade tips of at least one fan of an overlapping pair are variably spaced.

In preferred embodiments, both fans of an overlapping pair have blades which are forward-swept at their tips. This geometry has been found to have good efficiency as well as reduced fan noise relative to other geometries. This may be due to the fact that forward-swept blades have a relatively high tolerance of flow unsteadiness, such as that experienced when the blades move into, and out of, the overlap region.

In preferred embodiments, one fan of an overlapping pair rotates in the clockwise direction and the other fan rotates in the counter-clockwise direction, and the downstream fan has tip leading-edge sweep which is opposite the upstream fan tip trailing-edge sweep. In this configuration the downstream fan crosses the wake of the upstream fan in such a way that the unsteady forces on the different blade sections tend to cancel each other out, thereby reducing acoustic tones.

In other preferred embodiments, both fans of an overlapping pair rotate in the same direction, and the downstream fan has tip leading-edge sweep which is of the same sign as the upstream fan tip trailing-edge sweep. This is another configuration offering reduced tones.

In a most-preferred embodiment, the upstream fan of an overlapping pair has root trailing-edge sweep in the direction opposite the tip trailing-edge sweep.

The invention can be placed either upstream or downstream of a heat exchanger, or be placed between two heat exchangers.

The motors can be DC motors, and can be either mechanically or electronically commutated.

In preferred embodiments, the shroud comprises a barrel surrounding at least one of the pair of overlapping fans, and that barrel extends into the region upstream or downstream of the other fan of the pair, and contributes to the support of the mount of the motor of that other fan.

LIST OF FIGURES

FIG. 1*a* shows a schematic of a single-fan assembly and a 1.35 aspect ratio core.

FIG. 1*b* shows a schematic of a non-overlapping dual fan assembly and a 1.35 aspect ratio core.

FIG. 1*c* shows a schematic of a non-overlapping 3-fan assembly and a 1.35 aspect ratio core.

FIG. 1*d* shows a schematic of an overlapping dual-fan assembly and a 1.35 aspect ratio core.

FIG. 1*e* shows a schematic of an overlapping 3-fan assembly and a 1.35 aspect ratio core.

FIG. 7 shows fan blade outlines in the overlap region, where both fans rotate in the same direction and the blade geometry is that of a preferred embodiment of the present invention.

DETAILED DESCRIPTION

FIGS. 1*a*–1*c* show schematic views of several different non-overlapping fan configurations on a core of 1.35 aspect ratio. FIG. 1*a* shows a single-fan arrangement, where the fan is the largest that will fit without overlapping the core boundaries. The area ratio, or ratio of fan disk area to core area, is 0.58. Disk area is defined as the area of a circular disk with a diameter equal to the diameter of the fan. Although in some situations an overlap of the core boundaries is permissible, large amounts of overlap have been found to result in an increase in fan noise.

FIGS. 1*b* and 1*c* show non-overlapping (side-by-side) configurations for two- and three-fan configurations, also on a 1.35 aspect ratio core. These configurations also have an area ratio of approximately 0.58. Here fan disk area is taken to be the sum of the disk areas of the fans. In FIGS. 1*b* and 1*c* the blade tips of adjacent fans would touch at the point of tangency of the fan disks. In practice, the presence of any rotating tip band and the required running clearances would reduce the area ratio to a value somewhat less than that calculated.

FIGS. 1*d* and 1*e* show schematic views of overlapping fan configurations on a 1.35 aspect ratio core. Overlapping fan configurations in general offer larger area ratios than non-overlapping configurations at this core aspect ratio. FIG. 1*d* is a dual-fan arrangement which offers an area ratio of 0.68. FIG. 1*e* is a 3-fan arrangement that has an area ratio almost as high. Here fan disk area is taken to be the sum of the disk areas of the fans, minus the overlap area.

In addition to the better core coverage offered by overlapping fans, these configurations also improve fan efficiency in those cases where the fraction of fan power expended in accelerating air through the fan is significant compared to that expended in overcoming the resistance of the core. This portion of fan power can be reduced by minimizing axial velocity through the fan by maximizing fan disk area.

Figure 2:
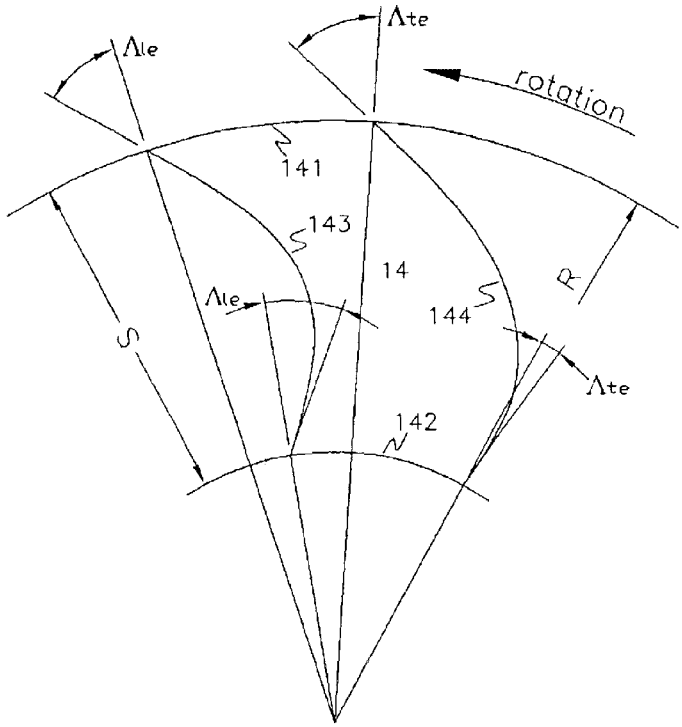
FIG. 2 shows an axial view of a fan blade in which the leading-edge and trailing-edge sweep angles are defined.

FIG. 2 shows the outline of a fan blade. An arrow indicates the direction of rotation. Blade 14 has a tip 141, a root 142, a leading edge 143 and a trailing edge 144. The leading edge sweep angle $\Lambda_{le}$ and trailing edge sweep angle $\Lambda_{te}$ are shown at the root and tip of the blade. Each of these sweep angles is defined as the angle between the tangent to the blade edge at a given radius and the radial line to the edge at that radius. The sign of the sweep angle is defined relative to the rotation direction of the fan. The fan shown in FIG. 2 has leading and trailing edge sweep angles which are positive at the tip and negative at the root. Both the leading and trailing edges are therefore considered forward-swept at the tip (swept in the direction of rotation) and back-swept at the root (swept opposite the direction of rotation). Radial dimension "R" as shown is one half the fan diameter. The blade span is defined as the radial extent of the blade, and is shown as "s."

Figure 3:
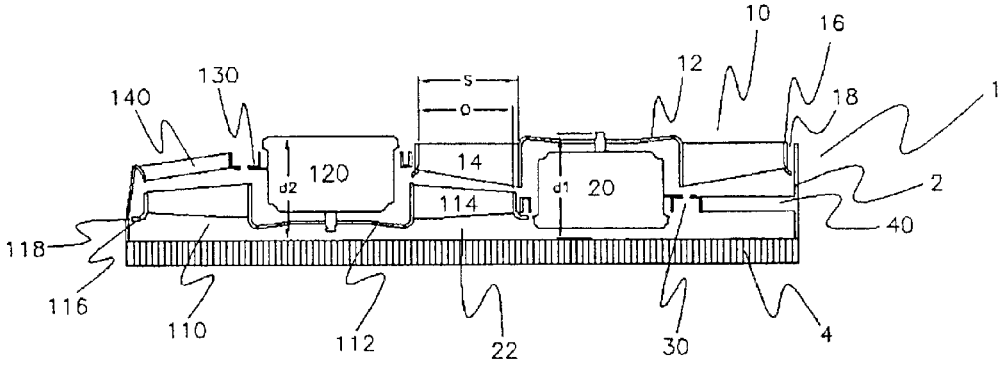
FIG. 3 shows a sectional view of an overlapping dual-fan assembly according to the present invention, wherein the blades are shown in a "swept" view.

FIG. 3 is a section through an overlapping dual-fan assembly according to the present invention, mounted downstream of heat exchanger core 4. The plane of the section contains the rotation axes of two overlapping fans 10 and 20. Fan 10 is powered by electric DC motor 20, which is attached to mount 30. Mount 30 is supported by arms 40, which are supported by shroud 2. Fan 110 is powered by electric DC motor 120, which is attached to mount 130. Mount 130 is supported by arms 140, which are supported by shroud 2. Fans 10 and 110 overlap each other in an overlap region 22. Support arms 40 are placed upstream of fan 10. This means that the flow of air encounters support arms 40 before it encounters fan 10. Support arms 140 are placed downstream of fan 110. The flow of air encounters support arms 140 after it encounters fan 110. It can be seen that the assembly is extremely compact axially. Mounts 30 and 130, support arms 40 and 140, and shroud 2 are molded as a single plastic part.

Fan blades 14 and 114 are represented by a "swept" view showing the axial extent of the blades as a function of radius. The blades are attached to rotating tip bands 16 and 116, which help maintain blade loading in overlap region 22. Rotating tip bands 16 and 116 have close running clearances 18 and 118 with respect to shroud 2 outside of this region. These clearances are less than 2 percent of the fan diameter. These close clearances minimize the re-circulation that otherwise would be created by the significant pressure rise developed by an automotive engine-cooling fan.

In this embodiment, the fans are of equal diameter. Blade span is shown as "s." The extent of blade overlap is shown as dimension "o." Dimension "o" is slightly smaller than dimension "s." Blades 14 do not pass behind fan hub 112 and blades 114 do not pass in front of hub 12. This limitation on overlap minimizes the acoustic tones generated by fans 10 and 110.

The maximum distance between the face of core 4 and motor 20 is shown as d1, and the maximum distance between the face of core 4 and motor 120 is shown as d2. d1 is shown to be approximately equal to d2. In preferred embodiments the difference between d1 and d2 is less than 25 percent of the smaller of d1 and d2.

Figure 4:
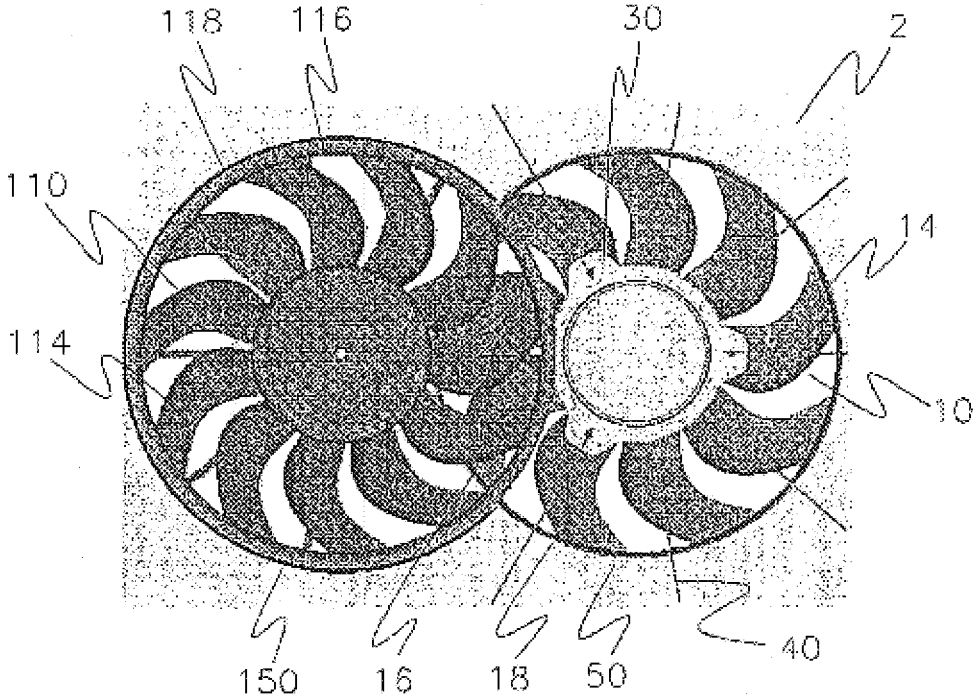
FIG. 4 shows an axial upstream view of an overlapping dual-fan assembly according to the present invention.

FIG. 4 is an axial upstream view of the overlapping dual-fan assembly of FIG. 3. Fans 10 and 110 clearly overlap each other in this view. Fan 10 has nine blades 14 and fan 110 has eleven blades 114. Fan tones are minimized by using different numbers of blades on the two fans.

It can be seen that upstream support arms 40 do not include any members whose projected area falls within the projected disk area of fan 110. This arrangement allows fan 110 and support arms 40 to be located in the same axial position, thereby minimizing the axial extent of the fan assembly. Although support arms 40 are shown as a set of radially-extending elements, many other configurations of support arms can be used. For example, non-radial, or swept, support arms can be used, and cross-bracing or intermediate ring structures can provide additional support.

Although motor mount 30 is shown as a generally circular member with several mounting tabs, many other configurations of motor mount can be used.

The area of heat exchanger core covered by shroud 2 is approximately rectangular, with aspect ratio of 1.44. Each fan has a diameter approximately 0.79 times the smaller dimension of this area.

The cross-sections of upstream support arms 40 are slender, and are oriented so as to minimize the obstruction to the flow, and to ensure moldability in the area outside the circumference of shroud barrel 50.

The clearance gap 18 between band 16 and shroud barrel 50, and the clearance gap 118 between band 116 and shroud barrel 150 are less than 2 percent of the respective fan diameters in regions outside the overlap region 22.

Figure 5:
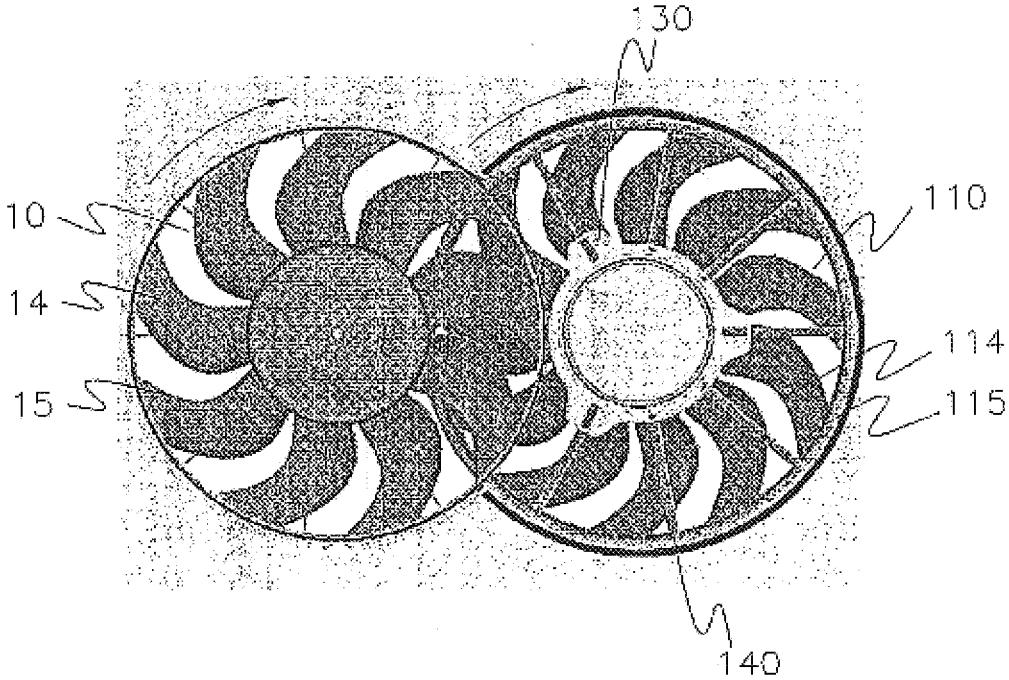
FIG. 5 shows an axial downstream view of an overlapping dual-fan assembly according to the present invention.

FIG. 5 is a downstream axial view of the fan assembly shown in FIGS. 3 and 4. It can be seen that support arms 140 do not include any members whose projected area falls within the projected disk area of fan 10. Support arms 140 can be seen to be a set of radially-extending stator blades, each angled with respect to the axial direction, as is often the case with support arms placed downstream of an engine-cooling fan. As with the upstream supports arms, many other support arm configurations can be used.

Arrows indicate that fans 10 and 110 both rotate in the same direction (clockwise in this view). This arrangement causes blades 14 to move counter to blades 114 in the overlap region. In this region, swirl generated by fan 110 is somewhat cancelled by that generated by fan 10. This arrangement can result in somewhat higher efficiency than the arrangement where the blades move in the same direction in the overlap region.

Fan blades 14 and 114 have leading edges 15 and 115 which are forward-swept at the blade tips. Forward-swept blades generally show a high tolerance to flow unsteadiness, such as that experienced by the blades of overlapping fans. This tolerance can result in higher efficiency and lower noise when compared to a back-skewed design.

Figure 6:
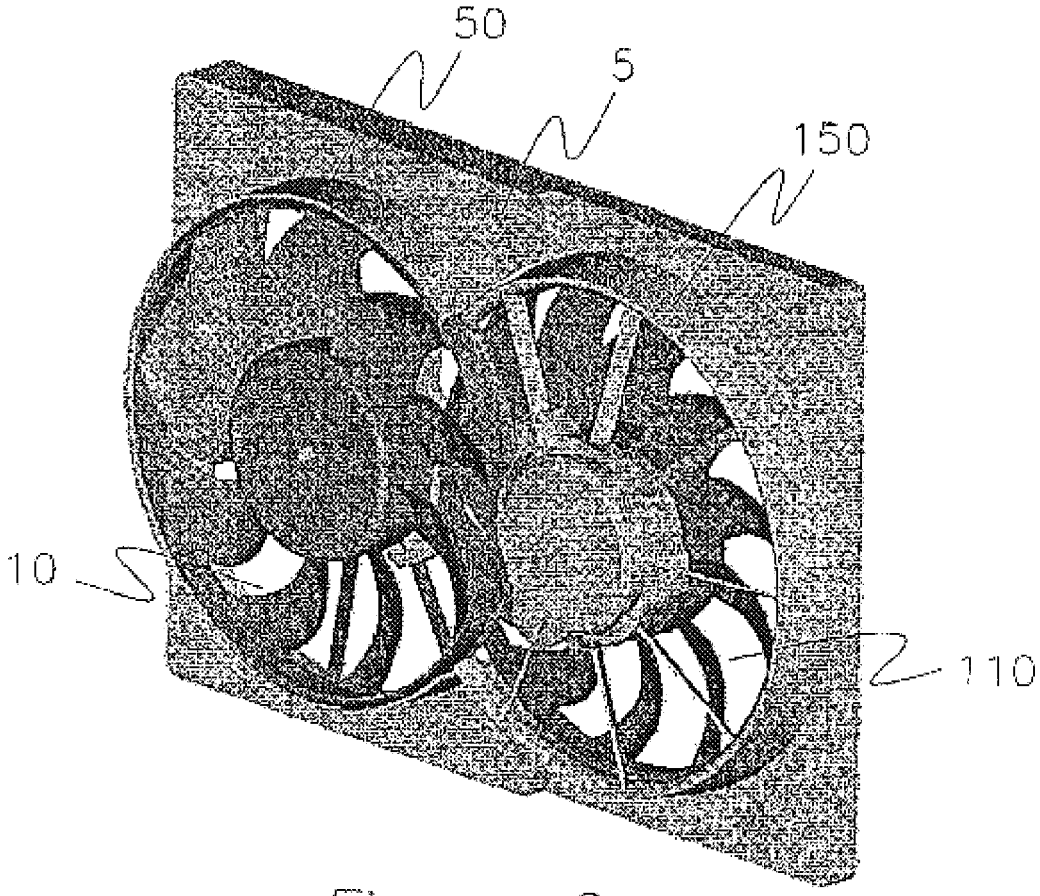
FIG. 6 shows a perspective view of an overlapping dual-fan assembly according to the present invention.

FIG. 6 is a perspective view of the fan assembly shown in FIGS. 3, 4 and 5. It can be seen that the shroud plenum 5 is deeper in the area of shroud 2 adjacent to downstream fan 10 than it is in the area adjacent to upstream fan 110. This arrangement maximizes the efficiency of the assembly by improving the uniformity of flow through the portion of the core adjacent to fan 10, while maintaining the axial compactness of the assembly. Shroud barrels 50 and 150 provide leakage control outside of the overlap region.

FIG. 7 is a detail view of the overlapping fan assembly shown in FIGS. 3 through 6. It shows the fan blade outlines in the overlap region, viewed axially from downstream. Both fans rotate in the clockwise direction. The upstream blade trailing edge is forward-swept at the tip and back-swept at the root, and the downstream blade leading edge is forward-swept at the tip. The downstream blade is shown at four different rotation angles, and the upstream blade is rotated in each case to show the intersection angle between the tip section of the downstream blade leading edge and the upstream blade trailing edge. Since the axial space between the fans is small, this angle is approximately the angle at which the downstream blade crosses the wake of the upstream blade. In order to minimize fan tones, this angle should ideally be near 90 degrees, but due to the variable geometry presented by the rotating blades, such an ideal arrangement cannot be achieved. The arrangement shown exhibits favorable intersection angles at three of the four rotation angles shown. At the 55 degree rotation angle the downstream blade leading edge is momentarily parallel to the upstream blade trailing edge, but this condition will only exist for a short period of time.

Figure 8:
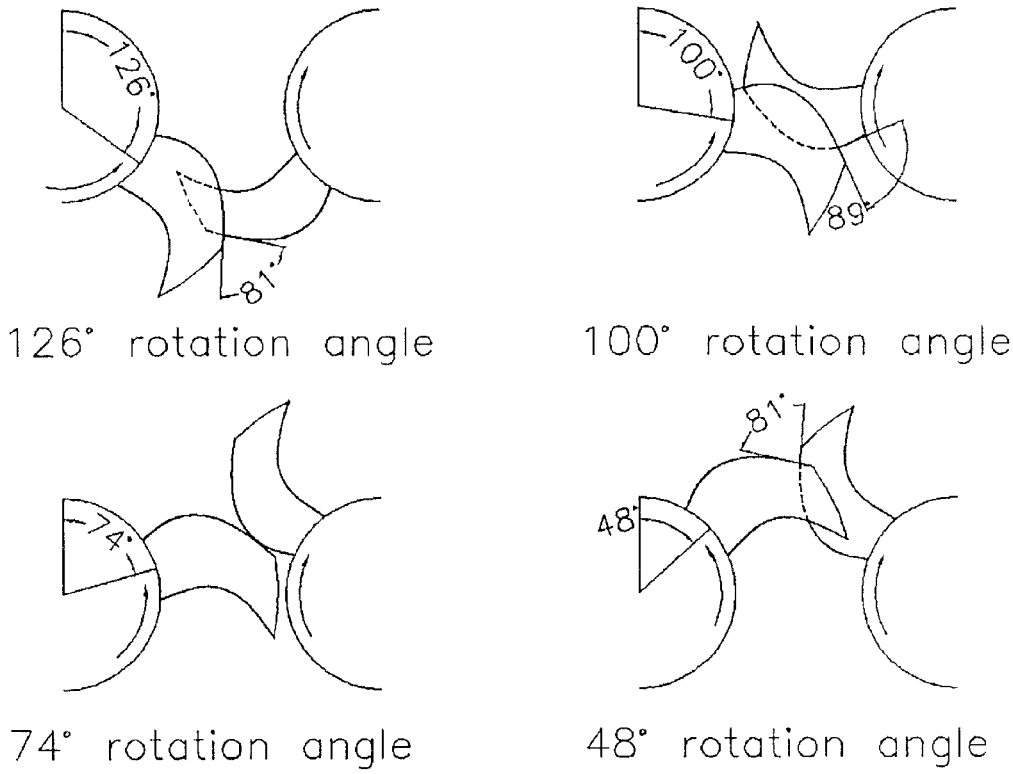
FIG. 8 shows fan blade outlines in the overlap region, where the fans rotate in opposite directions and the blade geometry is that of another preferred embodiment of the present invention.

FIG. 8 is a view similar to that of FIG. 7, but where the fans rotate in opposite directions. The upstream fan rotates clockwise, and its trailing edge is forward-swept at the tip and back-swept at the root. The downstream fan rotates counter-clockwise, and its leading edge is back-swept at the tip. As in FIG. 7, the downstream blade is shown at four different rotation angles, and the upstream blade is rotated in each case to show the intersection angle between the tip section of the downstream blade leading edge and the upstream blade trailing edge. Favorable intersection angles exist at three of the four rotation angles shown. At the 74 degree rotation angle the downstream blade leading edge is momentarily parallel to the upstream blade trailing edge, but this condition will only exist for a short period of time.

Figure 9:
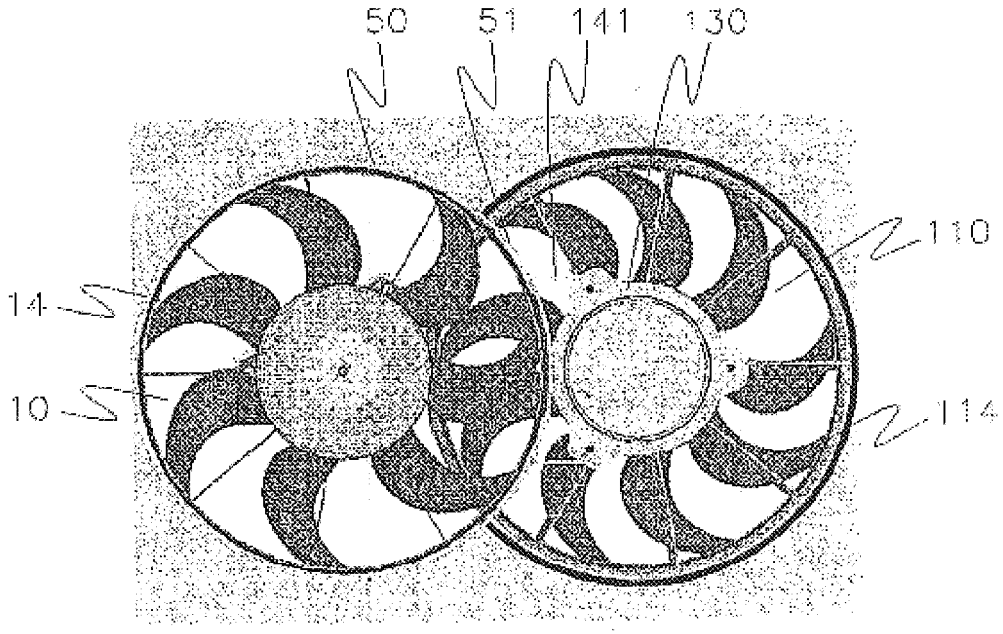
FIG. 9 shows an axial downstream view of an overlapping dual-fan assembly according to the present invention, showing fans with uneven blade tip spacing and the shroud barrel surrounding the downstream fan extended into the region downstream of the upstream fan.

FIG. 9 is a downstream axial view of an assembly similar to that shown in FIG. 5. In this assembly fans 10 and 110 have blades 14 and 114 that are evenly-spaced at the roots and unevenly-spaced at the tips, in accordance with U.S. Pat. No. 5,000,660. The use of unevenly-spaced blade tips on at least one, and preferably both, of the two fans can improve the subjective noise quality of the fan assembly. Similar noise improvement can be obtained by the use of unevenly-spaced blades.

FIG. 9 also shows shroud barrel 50, which surrounds downstream fan 10, extended into the region downstream of fan 110. Extension 51 provides additional support for motor mount 130, both directly and through additional support arms 141. A similar extension of the shroud barrel surrounding the upstream fan can provide structural benefit.

Those skilled in the art will recognize that other embodiments are within the following claims. For example, the invention may not include a plenum at all; alternatively, the invention may include a plenum, only a portion of which is integral with the barrel and motor mounts, the remainder of the plenum being provided as a separate part.

What is claimed is:

1. An automotive engine-cooling fan assembly comprising a) a first fan driven by a first motor, said first motor being supported by a first motor mount, said first motor mount being supported by a first set of arms, said first set of arms extending to and being supported by a shroud, and b) a second fan, driven by a second motor, said second motor being supported by a second motor mount, said second motor mount being supported by a second set of arms, said second set of arms extending to and being supported by said shroud, and c) a heat exchanger, and where said shroud guides the flow of air at least a portion of the distance between said fans and the core of a heat exchanger, and where said first fan and said second fan are each characterized by a diameter, and where said first fan and said second fan each comprise a hub and a plurality of elongated blades, each of said blades having a root, a tip, a leading edge, and a trailing edge, further characterized in that said first and second fans overlap each other when viewed axially from the upstream or downstream direction, and further characterized in that said first set of arms is located upstream of said first fan and said second set of arms is located downstream of said second fan.

2. The automotive engine-cooling fan assembly of claim 1 in which a small clearance gap is maintained between said shroud and each of said fans along the portion of the fan's circumference outside the overlap region.

3. An automotive engine-cooling fan assembly according to claim 1 further characterized in that the axial position of said first fan is substantially the same as the axial position of said second set of arms and the axial position of said second fan is substantially the same as the axial position of said first set of arms.

4. An automotive engine-cooling fan assembly according to claim 1 further characterized in that when said first and second sets of arms are projected onto a plane perpendicular to the axis of one or both of said fans, and said first and second fans are projected onto said plane, the projected area of said second set of arms falls outside a first circular disk centered on the projection of the axis of said first fan, the diameter of said first disk being equal to the diameter of said first fan, and the projected area of said first set of arms falls outside a second circular disk centered on the projection of the axis of said second fan, the diameter of said second disk being equal to the diameter of said second fan.

5. An automotive engine-cooling fan assembly according to claim 1 further characterized in that the distance between said heat exchanger core and the farthest point on said first motor is between 0.8 and 1.25 times the distance between said core and the farthest point on said second motor.

6. The automotive engine-cooling fan assembly of any one of claims 1–4 further comprising no additional fans.

7. The automotive engine-cooling fan assembly of any one of claims 1–4 further comprising at least one fan in addition to said first fan and said second fan.

8. The automotive engine-cooling fan assembly of claim 6 in which said fans move air through an approximately rectangular area of said heat-exchanger core, and the larger dimension of said rectangular area is between 1.25 and 1.8 times the smaller dimension of said rectangular area.

9. The automotive engine-cooling fan assembly of claim 6 in which the diameters of the two fans are equal, or, if unequal, the diameter of the smallest of said fans is greater than 0.85 times the diameter of the largest of said fans.

10. The automotive engine-cooling fan assembly of claim 8 in which the diameter of at least one of said fans is greater than 0.75 times said smaller dimension of said rectangular area.

11. The automotive engine-cooling fan assembly of any one of claims 1–4 in which the extent of overlap, when measured in a plane which contains the rotation axis of at least one of said fans and at least one point on the axis of the other fan, is greater than 10 percent of the diameter of the smaller of said fans, and less than the blade span of the smaller of said fans.

12. The automotive engine-cooling fan assembly of any one of claims 1–4 in which the motors are electric motors.

13. The automotive engine-cooling fan assembly of any one of claims 1–4 comprising a plenum between said fans and said heat-exchanger core, in which the depth of said plenum adjacent to the fan farther from the core is greater than the depth adjacent to the fan closer to the core.

14. The automotive engine-cooling fan assembly of any one of claims 1–4 in which the clearance gap between said shroud and each of said fans is less than 2 percent of the fan diameter along a substantial fraction of the non-overlapping portion of the fan's circumference.

15. The automotive engine-cooling fan assembly of any one of claims 1–4 in which at least one of the fans is banded.

16. The automotive engine-cooling fan assembly of any one of claims 1–4 in which, viewed axially from the downstream direction, one of said fans rotates in the clockwise direction and the other of said fans rotates in the counter-clockwise direction.

17. The automotive engine-cooling fan assembly of any one of claims 1–4 in which, viewed axially from the downstream direction, both of said fans rotate in the same direction.

18. The automotive engine-cooling fan assembly of any one of claims 1–4 in which said first fan has a first number of blades and said second fan has a second number of blades, and the first number of blades is unequal to the second number of blades.

19. The automotive engine-cooling fan assembly of any one of claims 1–4, in which at least one of said plurality of blades has unevenly spaced blade tips.

20. The automotive engine-cooling fan assembly of any one of claims 1–4 in which both of said fans have forward-swept leading edges at the tip.

21. The automotive engine-cooling fan assembly of claim 16 in which the downstream fan has tip leading-edge sweep which is opposite the upstream fan tip trailing-edge sweep.

22. The automotive engine-cooling fan assembly of claim 17 in which the downstream fan has tip leading-edge sweep which is of the same sign as the upstream fan tip trailing-edge sweep.

23. The automotive engine-cooling fan assembly of claim 21 in which the upstream fan has root trailing-edge sweep in a direction opposite the tip trailing-edge sweep.

24. The automotive engine-cooling fan assembly of claim 22 in which the upstream fan has root trailing-edge sweep in a direction opposite the tip trailing-edge sweep.

25. The automotive engine-cooling fan assembly of any one of claims 1–4 in which said fans are made of injection-molded plastic.

26. The automotive engine-cooling fan assembly of any one of claims 1–4 in which said first motor mount, said first set of arms, said second motor mount, said second set of arms, and at least a portion of said shroud are made of injection-molded plastic.

27. The automotive engine-cooling fan assembly of claim 26 in which a single injection molded part comprises said first motor mount, said first set of arms, said second motor mount, said second set of arms, and at least a portion of said shroud.

28. The automotive engine-cooling fan assembly of claim 1 in which a projection of the shroud opening in a plane perpendicular to at least one fan axis is two generally circular elements that overlap in the region of fan overlap.

29. The automotive engine-cooling fan assembly of any one of claims 1–4 in which the shroud comprises a barrel surrounding said first fan, and said barrel extends into the region axially downstream of said second fan, and contributes to the support of said second motor mount.

30. The automotive engine-cooling fan assembly of any one of claims 1–4 in which the shroud comprises a barrel surrounding said second fan, and said barrel extends into the region axially upstream of said first fan, and contributes to the support of said first motor mount.

* * * * *